US009493867B2

(12) United States Patent
Smeyers et al.

(10) Patent No.: US 9,493,867 B2
(45) Date of Patent: Nov. 15, 2016

(54) METHOD OF MANUFACTURING A STRUCTURAL AUTOMOTIVE PART MADE FROM A ROLLED AL—ZN ALLOY

(75) Inventors: Axel Alexander Maria Smeyers, Heist op den Berg (BE); Sunil Khosla, Beverwijk (NL)

(73) Assignee: ALERIS ALUMINUM DUFFEL BVBA, Duffel (BE)

( * ) Notice: Subject to any disclaimer, the term of this patent is extended or adjusted under 35 U.S.C. 154(b) by 115 days.

(21) Appl. No.: 13/877,631

(22) PCT Filed: Nov. 2, 2011

(86) PCT No.: PCT/EP2011/069217

§ 371 (c)(1),
(2), (4) Date: Apr. 3, 2013

(87) PCT Pub. No.: WO2012/059505

PCT Pub. Date: May 10, 2012

(65) Prior Publication Data

US 2013/0216790 A1 Aug. 22, 2013

(30) Foreign Application Priority Data

Nov. 5, 2010 (EP) ..... 10190110

(51) Int. Cl.
*C22F 1/053* (2006.01)
*C22C 21/10* (2006.01)

(52) U.S. Cl.
CPC ..... *C22F 1/053* (2013.01); *C22C 21/10* (2013.01); *Y10T 428/24628* (2015.01)

(58) Field of Classification Search
CPC ..... C22C 21/10; Y10T 428/24628; C22F 1/053

(Continued)

(56) References Cited

U.S. PATENT DOCUMENTS 5,888,320 A 3/1999 Dorward
6,342,111 B1 1/2002 Meki et al.
(Continued)

FOREIGN PATENT DOCUMENTS

CH 700835 A2 10/2010
DE 102004002899 A1 8/2005
(Continued)

OTHER PUBLICATIONS

International Preliminary Report on Patentability mailed May 7, 2013 for International Patent Application No. PCT/EP2011/069217 having an International filing date of Nov. 2, 2011.
(Continued)

*Primary Examiner* — Jessee Roe
*Assistant Examiner* — Jenny Wu
(74) *Attorney, Agent, or Firm* — Vorys, Sater, Seymour and Pease LLP

(57) ABSTRACT

A method of manufacturing a formed aluminum alloy structural part or a body-in-white (BIW) part of a motor vehicle. The method includes: providing a rolled aluminum sheet product wherein the aluminum alloy is an AA7000-series aluminum alloy and has a gauge in a range of 0.5-4 mm and is subjected to a solution heat treatment and has been cooled, forming the aluminum alloy sheet to obtain a three-dimensional formed part, heating the three-dimensional formed part to at least one pre-ageing temperature between 50-250° C., and subjecting the formed and pre-aged motor vehicle component to a paint bake cycle.

22 Claims, 1 Drawing Sheet

(58) Field of Classification Search
USPC ..... 148/537, 698
See application file for complete search history.

(56) References Cited

U.S. PATENT DOCUMENTS

| | | | | |
|---|---|---|---|---|
| 2004/0011438 | A1 | 1/2004 | Lorentzen et al. | |
| 2004/0211498 | A1* | 10/2004 | Keidel et al. | 148/690 |
| 2005/0028894 | A1* | 2/2005 | Hoffmann et al. | 148/417 |
| 2006/0070689 | A1* | 4/2006 | Kropfl | C22F 1/04 148/698 |
| 2009/0269608 | A1* | 10/2009 | Benedictus | C22C 21/10 428/600 |

FOREIGN PATENT DOCUMENTS

| | | | |
|---|---|---|---|
| EP | 1081242 | A1 | 3/2001 |
| WO | 9635819 | A1 | 11/1996 |
| WO | 03066927 | A1 | 8/2003 |
| WO | 2010049445 | A1 | 5/2010 |
| WO | WO 2010049445 | A1 * | 5/2010 |
| WO | 2010142579 | A1 | 12/2010 |

OTHER PUBLICATIONS

International Search Report mailed Dec. 16, 2011 for International Patent Application No. PCT/EP2011/069217 having an International filing date of Nov. 2, 2011.

* cited by examiner

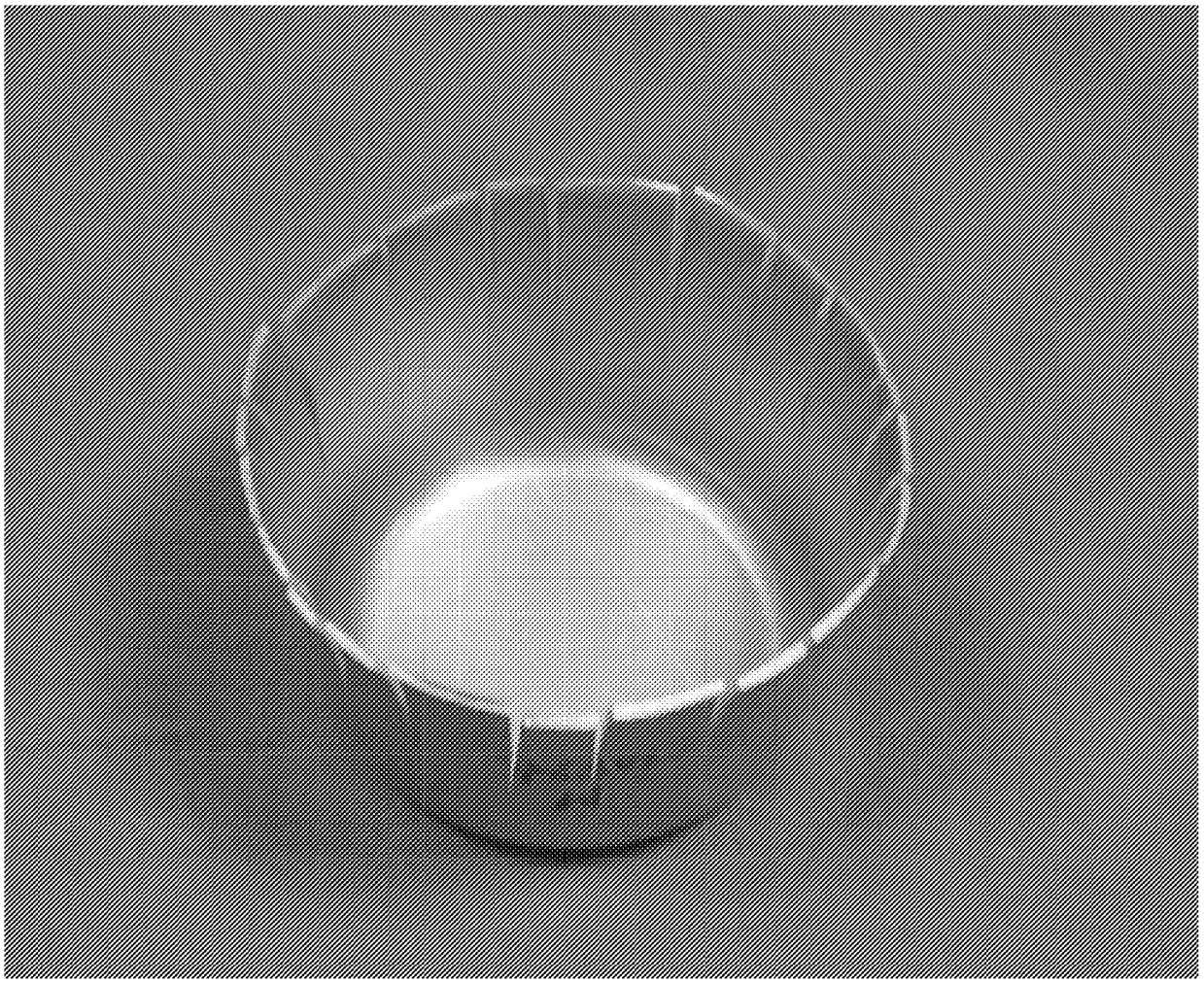

METHOD OF MANUFACTURING A STRUCTURAL AUTOMOTIVE PART MADE FROM A ROLLED AL—ZN ALLOY

CROSS-REFERENCE TO RELATED APPLICATIONS

This is a §371 National Stage Application of International Application No. PCT/EP2011/069217 filed on 2 Nov. 2011, claiming the priority of European Patent Application No. 10190110.6 filed on 5 Nov. 2010.

FIELD OF THE INVENTION

The invention relates to a method of manufacturing a formed aluminium alloy structural part or body-in-white (BIW) part of a motor vehicle, wherein the aluminium alloy is an AA7000-series alloy.

BACKGROUND TO THE INVENTION

As will be appreciated herein below, except as otherwise indicated, aluminium alloy designations and temper designations refer to the Aluminum Association designations in Aluminum Standards and Data and the Registration Records, as published by the Aluminum Association in 2010.

For any description of alloy compositions or preferred alloy compositions, all references to percentages are by weight percent unless otherwise indicated.

Body-in-white consists of the structural components of the automobile, not including closures (e.g. door panels, hood panels, trunk lid panels).

In the production of motor vehicles in particular aluminium alloys the AA5xxx- and AA6xxx-series alloys like 5051, 5182, 5454, 5754, 6009, 6016, 6022, and 6111, have been used to produce automotive structural parts and body-in-white ("BIW") parts.

There is a demand for the use of aluminium alloys, in particular for formed structural and BIW parts, which are formable and having in particular increased strength after being subjected to a paint bake cycle. In addition, the properties normally required for such parts include a high formability for the forming operation (typically by means of stamping, deep drawing, or roll forming), high mechanical strength after paint baking so as to enabling down gauging thus minimising the weight of the part, good behaviour in the various assembly methods used in motor vehicle manufacturing such as spot welding, laser welding, laser brazing, clinching or riveting, and an acceptable cost for mass production.

International patent application WO-2010/049445-A1 (Aleris) discloses a structural automotive component made from an aluminium alloy sheet product having a gauge in a range of 0.5 to 4 mm, and having a composition consisting of, in wt. %: Zn 5.0-7.0, Mg 1.5-2.3, Cu max. 0.20, Zr 0.05-0.25, optionally Mn and/or Cr, Ti max. 0.15, Fe max. 0.4, Si max. 0.3, and balance is made by impurities and aluminium. The sheet product has been solution heat treatment (SHT) and cooled following said SHT, aged to a yield strength of at least 390 MPa, after aging formed to obtain a formed structural automotive component, then assembled with one or more other metal parts to form an assembly forming a motor vehicle component, and subjected a paint-bake cycle.

DESCRIPTION OF THE INVENTION

It is an object of the present invention to provide a method of manufacturing formed structural part made from an AA7000-series sheet alloy product.

It is another object of the invention to provide a method of manufacturing formed structural automotive part made from an AA7000-series sheet alloy product.

These and other objects and further advantages are met or exceeded by the present invention providing for a method of manufacturing a formed aluminium alloy structural part or a body-in-white (BIW) part of a motor vehicle, the method comprising the steps of:

a. providing a rolled aluminium sheet product wherein the aluminium alloy is an AA7000 series aluminium alloy and having a gauge in a range of about 0.5 mm to 4 mm, and preferably of about 0.7 to 3.5 mm, and being subjected to a heat treatment at a temperature placed in a phase field of the aluminium alloy where substantial strengthening is realised following a cooling operation, and including the often applied solution heat treatment ("SHT") followed by quenching, b. forming the aluminium alloy sheet to obtain a three-dimensional formed part, c. heating said three-dimensional formed part to a pre-ageing temperature in the range of between 50° C. and 250° C., and d. subjecting the formed and pre-aged part to a paint bake cycle, and wherein said paint bake cycle results in a yield strength of at least 350 MPa, and more preferably of at least 400 MPa, in said AA7000-series alloy product.

In accordance with this invention it has been found that applying a pre-bake or pre-ageing treatment after forming of the sheet product but prior to the paint bake cycle significantly reduced the delayed fracture sensitivity of the formed aluminium part made from the AA7000-series aluminium alloy sheet product. It has been found that AA7000-series sheet alloys when formed for example by means of stamping into three-dimensional components can be sensitive to fracture cracking when at ambient temperature in an ambient atmosphere like in a press shop, thus in a commonly non-aggressive corrosive environment. This results in that the stamped components may show significant tendency to the formation of cracks not immediately during or upon the forming operation but with some delay of only after a few hours or even firstly after several days in an ambient environment. This is herein also referred to as sensitivity to delayed crack formation. However, when subjecting the formed component to a pre-ageing treatment said sensitivity to delayed crack formation is significantly reduced, and by optimising the pre-ageing treatment in dependence of the forming operation and the alloy used, it can even be overcome.

The pre-ageing treatment may consist of one single heat-treatment, but may also be carried out as a series of two or more heat-treatment at different temperatures. And can be carried out as an isothermal heat-treatment(s), or alternatively as non-isothermal heat treatment(s) within the described temperature-time ranges.

A preferred upper-limit for the pre-aging temperature is about 210° C., preferably about 190° C., and more preferably about 140° C. A too high temperature may give raise to an adverse effect on the strength levels after the paint bake cycle.

A preferred lower-limit for the pre-ageing temperature is about 70° C. and more preferably about 100° C.

The pre-ageing treatment in the defined temperature range is preferably carried out such that the formed product is at the pre-ageing temperature for not longer than 5 hours to avoid a reduction in productivity, and more preferably not longer than about 1 hour. The minimum time is about 1 minute. Typically the pre-ageing treatment is carried out at the pre-ageing temperatures for several minutes, e.g. 2 to 30 minutes, such as about 4 or 8 minutes.

It has been found that an increasing pre-ageing time, in particular where working at the higher end of the temperature range, may tend towards a peak-aged or near-peak aged product giving raise to an over-aged alloy after the paint-bake cycle. An over-aged material commonly has improved corrosion performance against a trade-off of strength levels. The latter is not desired for the application of the sheet material in accordance with this invention.

Typical heat-up rates would be in a range of 5° C./hr to 300° C./hr.

It has been found that the precipitates formed during the pre-ageing treatment are fairly stable such that the cooling rate from the pre-age temperature to ambient temperature is not critical. As a consequence regular air cooling or ambient cooling to ambient temperature has been found to be a convenient way of cooling. Forced cooling rates by means of air, mist or water is preferably to be avoided as it may adversely increase the amount of distortion in the formed part.

The method according to this invention can be applied to a wide range of 7000-series aluminium alloys and some are more prone than others to sensitivity to delayed crack formation and there might also be an influence of the forming operation, in particular the degree of deformation in the formed sheet product. For that reason the time delay between the forming operation and the pre-ageing treatment can be varied to some extent, but is ideally kept relatively short. It is preferred that it is carried out within about 30 hours after the forming operation, and preferably within about 20 hours, and more preferably within about 12 hours.

It should be mentioned that pre-ageing heat-treatments are known in the art when manufacturing automotive components. However, these are heat-treatments on AA6000-series sheet alloy products after SHT and quenching and prior to any forming operations (e.g. stamping, deep drawing) in order to increase the so-called paint bake response, the latter being a significant strengthening of the alloy sheet during the automotive paint bake cycle. The application of a pre-age treatment enhances the kinetics of precipitation and decreases the precipitate size and lessens the average inter-particle separation. Thus it concerns a pre-ageing treatment applied to a different series of aluminium alloys, applied at a different moment in time in the production process and to achieve a different technical effect.

The rolled aluminium alloy sheet may be obtained by methods known in the art, and which include continuous casting or DC-casting of a rolling stock, homogenisation and/or preheating of the rolling stock, hot rolling and/or cold rolling to a final gauge typically in the range of about 0.5 to 4 mm. Depending on the alloy composition and the amount of cold work an intermediate anneal may be used before or during the cold rolling operation.

The heat treatment such as a SHT and quenching of the sheet product can be carried out as a continuous operation for example using a continuous annealing line, after which the sheet product is being coiled again. The coiled sheet product can then be transported to a press shop for further processing into a formed part.

As the SHT and quenched sheet product is in an instable condition due to the occurrence of a spontaneous natural ageing effect at ambient temperature (in the art also referred to as a W-condition), preferably the time between the quenching operation and the forming operation is less than 2 weeks and more preferably less than 4 days.

In an alternative embodiment the sheet product following SHT and quenching is artificially aged at a temperature in a range of 50° C. to 250° C. For example to an under-aged T6 temper, e.g. T61, T64 or T65 according to EN515. In a preferred embodiment the sheet product is aged to an over-aged T7x temper, for example a T79 temper. An advantage of using an over-aged temper is that during the paint-bake cycle there is substantially no further over-ageing, resulting in that there is no significant loss of strength in the sheet product as a consequence of the paint-bake cycle.

In an alternative embodiment the cold rolled sheet product is subjected to a heat treatment at a temperature placed in a phase field of the aluminium alloy where substantial strengthening is realised following a cooling operation, in particular it can be SHT followed by quenching, near or in the press shop such that the dwell time between cooling and the forming operation is being reduced. Depending on the logistic arrangements it may still be produced as a coiled product or alternatively firstly uncoiled, then cut in a separate sheet product having smaller dimensions, the cut sheet product being heat treated individually or in a small batch, subsequently cooled and formed, preferably within 4 hours after cooling, into a three-dimensional formed part or component.

If desired it is also possible that the heat treated and cooled sheet receives a controlled amount of stretching, typically in a range of 0.5% to 4%, to increase the flatness of the sheet product prior to any subsequent forming operation. In an alternative route the sheet product is compressed, typically in a range of 1% to 5%, for example using a die operation.

Following the heat treatment and cooling and optional stretching or compression, the sheet product can be formed into a three-dimensional formed BIW part or other structural component configuration of a motor vehicle.

The forming operation can be any forming operation used to shape three-dimensional motor vehicle components, and includes in particular operations like stamping, deep drawing, pressing, press forming, and roll forming, either at ambient or at elevated temperature.

Before shaping, the sheet product may be coated with a lubricant, oil or dry lubricant, suitable for the forming operation, the assembly and the surface treatment of the structural part to be produced.

Following the forming operation and the pre-ageing treatment the formed part is typically made part of an assembly of other metal components as is regular in the art for manufacturing vehicle components, and subjected to a paint bake operation to cure any paint or lacquer layer applied.

Alternatively the formed part is first made part of an assembly of other metal components as is regular in the art, e.g. a B-pillar, and then the whole assembly is subjected to the pre-ageing treatment and made part of a car body structure and followed by a separate paint bake operation to cure any paint or lacquer layer applied.

The assembling operation may involve a joining operation, such as for example hemming, welding, clinching or riveting.

The paint bake operation is a heat-treatment clearly separate from the pre-ageing treatment in accordance with this invention. The time delay between these two heat-treatments is predominantly set by logistical constraints when manufacturing the individual parts in mass production and including multiple handling steps. The time delay is more than about 1 hour and can be several days or even several weeks.

During the paint bake cycle the formed AA7000-series alloy product achieves its desired final strength levels. The paint bake operation or paint bake cycle typically comprises one or more sequential short heat treatment in the range of 140° C. to 200° C. for a period of 10 to less than 40 minutes, and typically of less than 30 minutes. A typical paint bake cycle would comprise a first heat treatment of about 180° C.@20 minutes, cooling to ambient temperature, then about 160° C.@20 minutes and cooling to ambient temperature. In dependence of the OEM such a paint bake cycle may comprise of 2 to even up to 5 sequential steps and includes drying steps, but either way the cumulated time at elevated temperature (100° C. to 200° C.) of the aluminium alloy product is less than 120 minutes.

The method according to this invention can be applied to a wide range of AA7000-series alloys, in particular those that show a tendency to natural ageing. In a preferred embodiment the aluminium alloy is selected from the group of AA7021, AA7136, AA7075, AA7081, AA7181, AA7085, AA7050, AA7150, AA7055, and modifications thereof.

In another preferred embodiment, the AA7000-series alloy comprises, in wt. %,

| | |
|---|---|
| Zn | 6 to 7 |
| Mg | 1.5 to 2.1 |
| Cu | 0 to 0.35 |
| Mn | 0 to 0.15, preferably 0 to 0.05, |
| Zr | 0.04 to 0.25 |
| Ti | 0 to 0.15 |
| Fe | 0 to 0.35 |
| Si | 0 to 0.25, |

other elements and unavoidable impurities, each maximum 0.05, total 0.20, balance aluminium.

In an embodiment the AA7000-series aluminium alloy sheet product has been provided with a metal clad layer applied on at least one side, wherein the metal clad layer material has an inner-surface and an outer-surface and wherein the inner-surface is facing the AA7000-series material.

The clad layer or clad layers are usually much thinner than the core sheet, and each clad layer constituting about 1% to 25% of the total composite sheet thickness. A clad layer more typically constitutes around about 1% to 14% of the total composite sheet thickness.

The clad layer material can be made from an AA3000, AA4000-, AA5000-, AA6000-, or a different AA7000-series aluminium alloy compared to the core alloy.

In an embodiment the clad layer material consists of an AA5000-series alloy having more than 3.8% of Mg. More preferably the clad layer material has more than 4.8% of Mg, and preferably less than 7%, and more preferably less than 5.9%. With the application of the clad layer in particular the characteristics for the pretreatment like phosphating, passivation or alternative processes used at OEM's are improved. Aluminium alloys of the AA5000-series are known to the automotive industry and having an AA5000-series alloy as outersurface results in that there are little or no adjustments required for the surface pretreatment of the composite structure compared to aluminium alloys already in use for automotive applications. Hence there are no problems with existing alloy systems. Another advantage of the composite structure is it can be used for making components having a high impact resistance or good crash performance. The application of an AA5000-series clad layer having a high Mg-content results in a favourable formation of less cracks at the surface as these alloys have a good bendability, while the defined AA7000-series core alloy provides the required high strength.

In an embodiment the clad layer material consists of an AA6000-series aluminium alloy to increase the overall corrosion performance of the formed part. Preferred alloys are AA6016 and AA6005-series alloys.

Due to this high yield strength after a paint bake cycle, good formability and low weight, the BIW part manufactured according to this invention is an ideal candidate to replace parts made from dual-phase steel such as steel grades dp600, dp800, and boron steels, leading to considerable weight saving opportunities in the motor vehicle.

In a further aspect of the invention the method is used to manufacture an automotive structural part or member, and preferably a structural part selected from the group of: a door beam, roof beam, side beam, instrumental panel support beam, pillar reinforcement, tunnel, B-pillar reinforcement, body-in-white part.

A preferred application of the method according to this invention is for the production of a pillar reinforcement, in particular a B-pillar reinforcement.

In a further aspect of the invention it relates to an formed structural motor vehicle part or a BIW part of a motor vehicle, the part being made from an AA7000-series aluminium alloy having a gauge in the range of 0.5 to 4 mm, and preferably in the range of 0.7 to 3.5 mm, and wherein the part has been SHT, quenched, formed from sheet into a three-dimensional formed part, and after being formed subject to a pre-ageing treatment by holding it at a temperature between 50° C. and 250° C., and most preferably between 70° C. and 170° C., to reduce the sensitivity to delayed cracking at ambient temperature. Thereafter the pre-aged formed part can be subjected to a paint bake cycle to provide a yield strength of at least 350 MPa, and more typically of at least 400 MPa.

In another aspect of the invention it relates to a motor vehicle incorporating a formed aluminium alloy BIW part obtained in accordance with the method of this invention.

The following example is provided to further illustrate the objectives and advantages of this invention. It is not intended to limit the scope of this invention in any manner, however.

EXAMPLE

Aluminium alloy sheet of 1.2 mm gauge and having a composition of about 7.3% Zn, about 1.95% Mg, about 0.07% Cu, about 0.1% Zr, balance impurities and aluminium, had been produced using a regular processing route. The sheet had been resolutionised and quenched (so-called "fresh W-temper") and immediately drawn into a cup using the well-known Erichson drawn-cup-test at ambient temperature and ambient atmosphere. Within 24 hours at ambient temperature and ambient atmosphere the drawn cup showed a serious formation of a series of cracks in the cup as shown in FIG. 1.

However, when the drawn cup was within about 1 hour subjected to a heat-treatment of 4 hours at 130° C. then no crack formation in the cup occurred and after 5 days the heat-treated cup had been successfully subjected to a simulated paint-bake cycle.

A similar effect occurred when the heat-treatment was carried about 0.5 hour and 10 hours after drawing of the cup.

It has also been found that the formation of cracks could be avoided using shorter heat-treatment times at 130° C.

The delayed fracture in drawn cups occurred also in the same sheet material but having been solution heat-treated, quenched and over-aged to a T79 temper prior to the drawing at ambient temperature and ambient atmosphere. Also here the pre-ageing heat treatment in accordance with this invention resulted in the avoidance of crack formation in the drawn cups and these pre-aged drawn cups after 5 days had been successfully subjected to a simulated paint-bake cycle.

While various embodiments of the technology described herein have been described in detail, it is apparent that modifications and adaptations of those embodiments will occur to those skilled in the art. However, it is to be expressly understood that such modifications and adaptations are within the spirit and scope of the presently disclosed technology.

The invention claimed is:

1. Method of manufacturing a formed aluminium alloy structural part or a body-in-white (BIW) part of a motor vehicle, the method comprising:

a. providing a rolled aluminium sheet product wherein the aluminium alloy is an AA7000 series aluminium alloy and having a gauge in a range of 0.5 to 4 mm and being subjected to a solution heat treatment and having been cooled, b. forming the aluminium alloy sheet to obtain a three-dimensional formed part, c. pre-ageing said three-dimensional formed part by heating to at least one pre-ageing temperature between 50° C. and 250° C. for a time period of 2 to 30 minutes and wherein the time-delay between the forming operation and the pre-ageing treatment is less than 20 hours, d. assembling the pre-aged formed part with one or more other metal parts to form an assembly forming a motor vehicle component, and e. subjecting the assembly with the formed and pre-aged part to a paint bake cycle, wherein the time delay between the pre-ageing treatment and the paint bake cycle is at least 1 hour, and wherein the AA7000 series formed and pre-aged part achieves its final strength level during the paint-baked cycle, wherein the pre-ageing occurs prior to the paint bake cycle.

2. Method according to claim 1, wherein said pre-ageing temperature is between 70° C. and 210° C.

3. Method according to claim 1, wherein said pre-ageing temperature is between 100° C. and 190° C.

4. Method according to claim 1, wherein the formed part is cooled using ambient cooling from pre-ageing temperature to ambient temperature.

5. Method according to claim 1, wherein the time-delay between the forming operation and the pre-ageing treatment is less than 12 hours.

6. Method according to claim 1, wherein the pre-ageing treatment and the paint bake cycle are carried out as separate heat-treatment.

7. Method according to claim 1, wherein for said formed part the accumulated time at elevated temperature during the paint bake cycle is less than 120 minutes.

8. Method according to claim 1, wherein the rolled aluminium sheet product has a metal clad layer on at least one side.

9. Method according to claim 1, wherein the aluminium sheet product has a chemical composition within AA7021, AA7136, AA7075, AA7081, AA7085, AA7050, or AA7055.

10. Method according to claim 1, wherein the aluminium sheet product has a composition of, in wt. %:

| | |
|---|---|
| Zn | 6 to 7 |
| Mg | 1.5 to 2.1 |
| Cu | 0 to 0.35 |
| Mn | 0 to 0.15 |
| Zr | 0.04 to 0.25 |
| Ti | 0 to 0.15 |
| Fe | 0 to 0.35 |
| Si | 0 to 0.25, |

other elements and unavoidable impurities, each maximum 0.05, total 0.20, balance aluminium.

11. Method according to claim 1, wherein the formed structural part is selected from the group of: a door beam, roof beam, side beam, instrumental panel support beam, pillar reinforcement, tunnel, and B-pillar reinforcement.

12. Method according to claim 1, wherein the formed structural part is a pillar reinforcement.

13. Method according to claim 1, wherein the formed part is for a period of 4 to 8 minutes at said pre-ageing temperature.

14. Method according to claim 13, wherein the pre-ageing temperature is between 50° C. and 100° C.

15. Method according to claim 1, wherein said pre-ageing temperature is not more than 140° C.

16. Method according to claim 13, wherein the pre-ageing temperature is not more than 140° C.

17. Method according to claim 1, wherein the aluminium alloy sheet product has been subjected to a solution heat treatment and quenched and natural aged for less than 2 weeks prior to forming.

18. Method according to claim 1, wherein the aluminium alloy sheet product has been subjected to a solution heat treatment and quenched and natural aged for less than 4 days prior to forming.

19. Method according to claim 1, wherein the aluminium alloy sheet product has been subjected to a solution heat treatment and quenched and artificially aged to an under-aged T6 temper prior to forming.

20. Method according to claim 1, wherein the aluminium alloy sheet product has been subjected to a solution heat treatment and quenched and artificially aged to an over-aged T7 temper prior to forming.

21. Method according to claim 1, wherein the aluminium alloy sheet product has been subjected to a solution heat treatment and quenched and stretching in a range of 0.5% to 4% prior to forming.

22. Method according to claim 1, wherein the formed part is cooled using ambient cooling from pre-ageing temperature to ambient temperature, wherein said pre-ageing temperature is not more than 140° C., wherein the formed part is for a period of 4 to 8 minutes at said pre-ageing temperature.

* * * * *